United States Patent [19]

Buselli

[11] Patent Number: 4,919,436

[45] Date of Patent: Apr. 24, 1990

[54] WALL MOUNTED DECORATIVE ART CONVERTIBLE TO A TOSS GAME WITH CATCH AREA

[76] Inventor: Oscar L. Buselli, 212 S. Sophie St., Bessemer, Mich. 49911

[21] Appl. No.: 331,611

[22] Filed: Mar. 30, 1989

[51] Int. Cl.[5] ..... A63F 9/02; F41J 1/00

[52] U.S. Cl. ..... 273/346; 273/407; 273/415; 273/DIG. 30

[58] Field of Search ..... 273/346, 347, 415, 407, 273/DIG. 30

[56] References Cited

U.S. PATENT DOCUMENTS

| | | | |
|---|---|---|---|
| 1,104,219 | 7/1914 | Polverino . | |
| 1,926,612 | 9/1933 | Day . | |
| 2,074,850 | 3/1937 | McCullough et al. . | |
| 2,145,434 | 1/1939 | Rubin | 273/347 |
| 2,234,814 | 3/1941 | Weaver . | |
| 2,506,189 | 5/1950 | Attridge . | |
| 3,026,110 | 3/1962 | Hess et al. | 273/424 X |
| 3,810,616 | 5/1974 | Murphy . | |
| 3,857,566 | 12/1974 | Lemelson et al. | 273/346 |
| 3,917,271 | 11/1975 | Lemelson et al. . | |
| 3,927,881 | 12/1975 | Lemelson et al. . | |
| 3,997,162 | 12/1976 | Scullin | 273/346 X |
| 4,055,343 | 10/1977 | Stuart | 273/346 X |
| 4,113,251 | 9/1978 | Imes, Jr. | 273/428 X |
| 4,415,154 | 11/1983 | Engelhardt | 273/346 X |
| 4,671,514 | 6/1987 | Wilson-Diehl | 273/DIG. 30 X |

*Primary Examiner*—William H. Grieb

*Attorney, Agent, or Firm*—Basile and Hanlon

[57] ABSTRACT

A wall hanging toss game includes a flat, rigid member having a first surface suitable for printing with recesses formed therein spaced from one another. A plurality of hook material targets are adhesively secured to the rigid member in the recesses of the first surface, such that the targets appear flush with the first surface and appear separated from one another by open areas of the first surface. The ratio of open area to target area is preferably greater than one to one. A shock absorbing projectile covered with or made of loop material is held in place when in contact with the hook material targets and reduces bounce-back when impacting the non-target areas. A frame surrounds the periphery of the rigid member and a catch member is provided for catching the projectile, when the projectile hits the first surface and falls vertically downwardly after missing the targets. The invention is a combined decorative wall hanging and wall toss game. The wall hanging is convertible to a wall toss game with the catch area extending outwardly from the rigid member for catching missed tosses. Preferably, the frame is hinged to the rigid member so that it can be pivoted between a first position and second position. The catch member is connected between the lower horizontal frame member and the rigid member. Preferably, the catch member can be hinged back for storage behind the rigid member when the frame member is in the first co-planar position.

15 Claims, 2 Drawing Sheets

WALL MOUNTED DECORATIVE ART CONVERTIBLE TO A TOSS GAME WITH CATCH AREA

FIELD OF THE INVENTION

The invention relates to a decorative wall hanging which is convertible to a wall toss game with separated targets used in combination with a catch area for catching missed tosses.

BACKGROUND OF THE INVENTION

Prior art wall games feature a tight grouping of targets, as in conventional darts, and normally feature a one-piece target material, as in the case of safety darts. In either case, the result is one large target area and therefore is limited in terms of creativity with regard to aesthetics and the variety of games possible. Prior art wall toss games typically include such things as traditional darts, plastic soft point darts, and safety darts, either tipped with a flat Velcro surface, or a Velcro covered ball. Traditional and plastic soft point darts use a target consisting of a tight grouping of different value targets separated by a thin wire or a ridge of plastic. These target types require a pointed dart to determine which target was hit. However, even the plastic pointed dart can cause eye injuries if used improperly. On the other hand, safety darts use one large target material divided by printed lines. These safety darts typically include a flat Velcro surface or a Velcro covered ball. Many times with these darts, it is difficult to tell a hit from a miss, because a toss can be on the line.

The present invention combines safety with targets that are separate and distinct, therefore having the advantage that a miss is obvious. The present invention takes full advantage of the high visibility of the wall hanging to provide an aesthetically pleasing and decorative wall hanging when the toss game is not in use. The present invention also combines separated targets with the use of a catch area which allows the design of a limitless variety of attractive games with no restriction on the placement, color, shape, size, or combined total of target surface area. Due to the flexibility in the design of the game, the present invention can advantageously be designed to appeal to different consumer groups, or to tie in with advertising, or to base a game format on a company slogan, or any popular current theme. The present invention works successfully as an advertising medium, because it is highly visible and gets people to interact.

SUMMARY OF THE INVENTION

The present invention is an improvement over the prior art wall toss games in that the present invention takes full advantage of the high visibility of the wall hanging. The separated targets are an important characteristic in the concept of the game. Separated targets are used as attractive ornamentation for the wall hanging. Targets are spaced from one another allowing areas in and around the targets to be used as printing surfaces. The targets are shaped and arranged in attractive patterns, symmetrical or otherwise. The targets are colored, shaped, and placed in regard to the theme of the wall hanging, and to the amount of background area needed for printing. The game provides for a high ratio of background surface area to target surface area, where the background surface area can be used as an advertising medium by the arrangement of a company name, logo, slogan or the like. Total target surface area is flexible in this regard. Targets can be shaped and colored to be the main theme of the wall hanging, or a lesser role allowing the printing to be used to state the theme.

The present invention includes separated Velcro hook targets mounted on a printable non-target surface which is flat and hard. Shock absorbing Velcro loop beanbags are used as the projectile in the game. The beanbags are tossed toward the target surface in an attempt to attach the beanbags to the target areas. A catching means needs to be provided to prevent missed tosses from falling to the floor, because a high percentage of tosses will impact the nontarget areas. The shock absorbing characteristics of the bean bags reduce bounce-back when impacting the non-target areas and therefore, the bean bags tend to fall downwardly into the catching means. The catch area may be fixed to the wall hanging or may be removable from the wall hanging. In a preferred embodiment, the catch area, when not set up for playing the wall toss game, hinges back to frame the game presenting the appearance of a decorative wall hanging. Velcro hook targets are a thin wafer-like material, which can be easily glued and recessed into a printable surface such as melamine, wood or the like. Targets appear flush with the printable surface which lends itself to being very compatible with printing. The target areas are able to hold the beanbag projectiles, or markers, on the surface, which can be used as ornamentation for the wall hanging. This allows for games to be designed, such as Tic-Tac-Toe, or other games where a player may attempt to cover as much of the target with his projectile as possible, making it more difficult for subsequent players to hit the same target.

These and other advantages, features and characteristics will become more apparent to those skilled in the art after reading the following detailed description of the invention in conjunction with the drawings

BRIEF DESCRIPTION OF THE DRAWINGS

In the drawings, like references numerals refer to similar elements throughout the various views, in which.

DESCRIPTION OF THE PREFERRED EMBODIMENT

Figure 2:
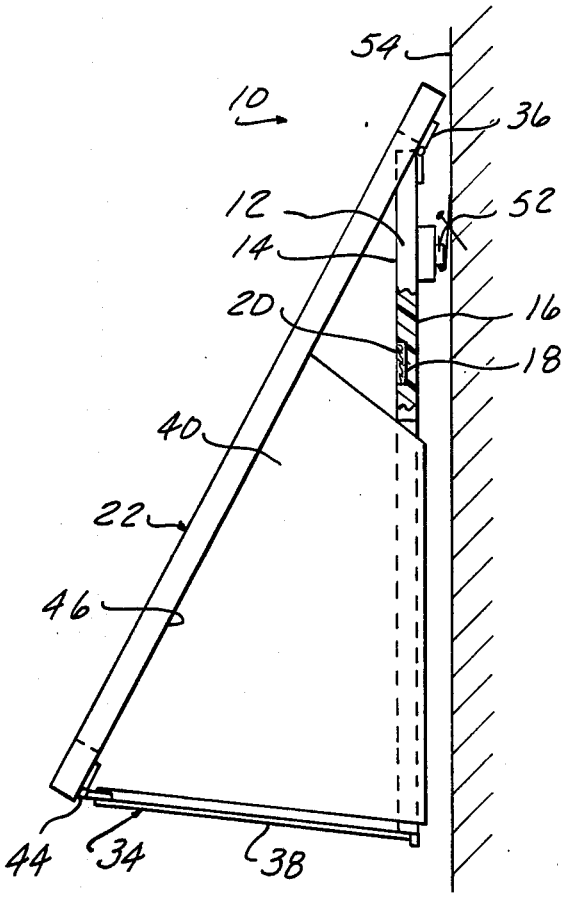
FIG. 2 is a side elevational view of the wall toss game with a catch area deployed according to a preferred embodiment of the present invention.
Figure 1:
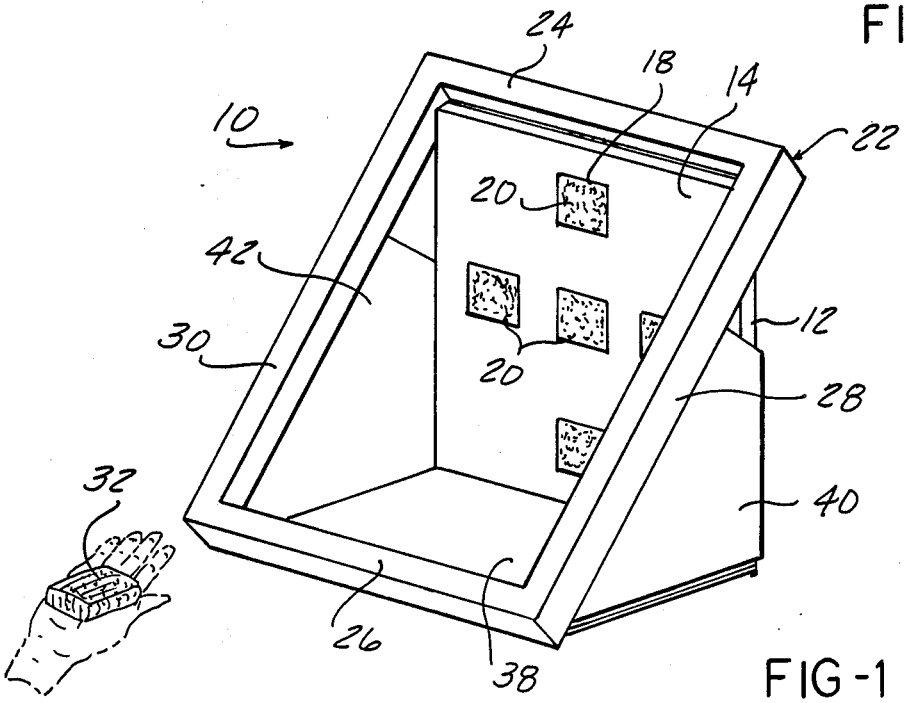
FIG. 1 is a perspective view of a wall toss game according to the present invention.

The wall hanging/wall toss game 10 is shown in a perspective view in FIG. 1. The wall hanging 10 includes a generally flat, rigid panel-like member 12 with a first surface 14 forming the front visible background portion of the wall hanging/wall toss game 10. A second surface 16 forms the rear of the panel-like member 12 which faces the vertical wall surface 54 that is used to support the wall hanging/wall toss game 10. As best seen in FIGS. 1 and 2, a plurality of recesses 18 are formed in the first surface 14, and a plurality of separated thin, wafer-like hook material targets 20 are adhesively secured within the recesses 18 such that the tagets 20 appear flush with the first surface 14. The hook material targets can be made in any color, shape, or size desirable from commercially available material, such as Velcro. Preferably, the targets 20 are separated from one another to provide a high ratio of background surface area 14 in between individual targets 20, wherein the first surface 14 can be made from materials, such as for example, plastic laminates, melamine, or a plywood veneer which can be stained, lacquered, or painted. In addition, it is anticipated that the first surface 14 is selected such that the surface is suitable for printing. The separated targets 20 provide an attractive ornamentation for the wall hanging when in a first stored position such as that shown in FIG. 3. A frame 22 surrounds the outer periphery of the rigid member 12. The frame 22 includes an upper horizontal frame member 24, a lower horizontal frame member 26, and spaced vertical frame members 28 and 30. A projectile 32, such as a bean filled bag, is provided for throwing at the targets 20 from a distance by a player. The projectile 32 has sufficient throwing weight while eliminating dangerous edges and points which can cause eye injuries. The projectile 32 is preferably made of or covered with a loop material, such as Velcro, capable of being securely held in place when in contact with the hook material targets 20. The projectile 32 has a shock absorbing quality which reduces bounce-back when impacting the first surface 14. The shock absorbing quality of the projectile 32 works in conjunction with the catch means 34, which is supported from the frame for catching and supporting the projectile, when the projectile 32 misses the target 20, and hits the first surface 14, thereafter falling vertically downwardly from the rigid member 12.

Figure 3:
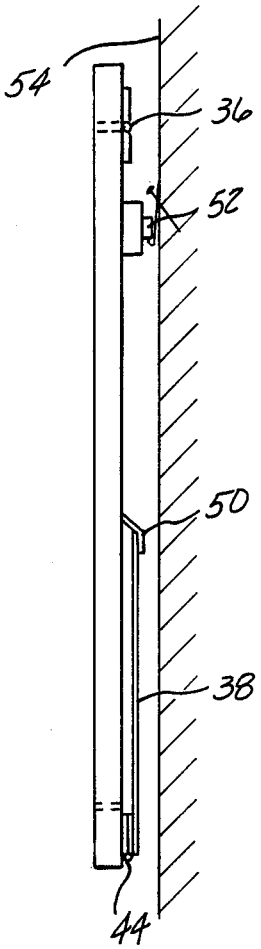
FIG. 3 is another side elevational view of the wall toss game with the catch area stored.
Figure 4:
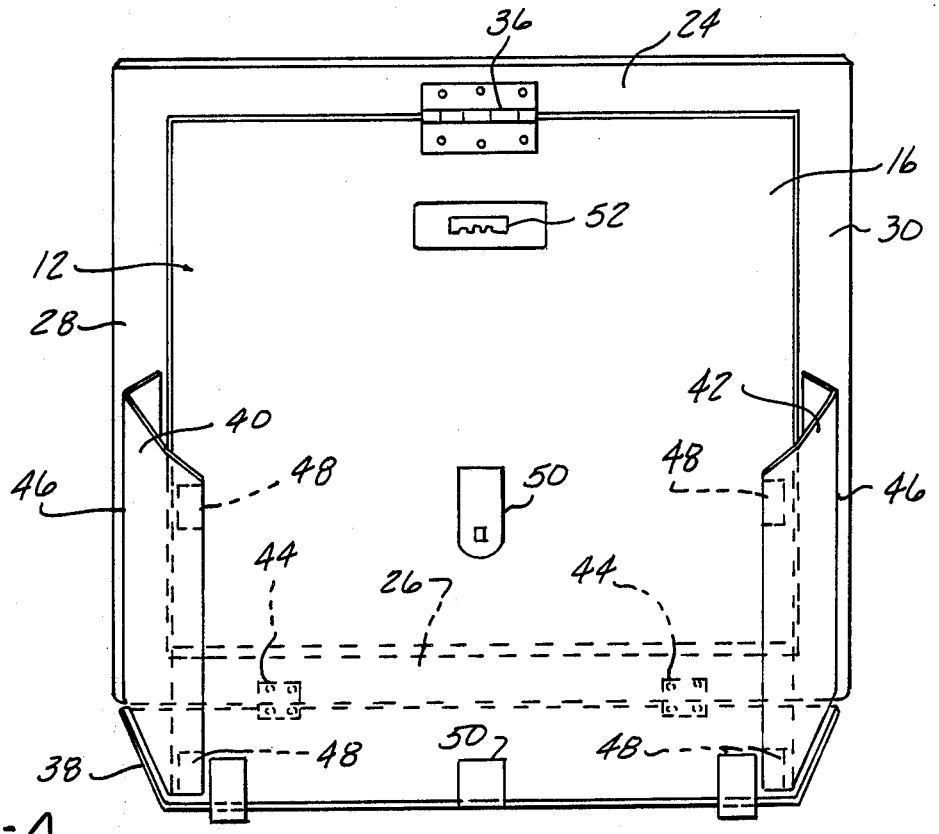
FIG. 4 is a rear view of the back of the wall toss game with the catch area deployed.
Figure 5:
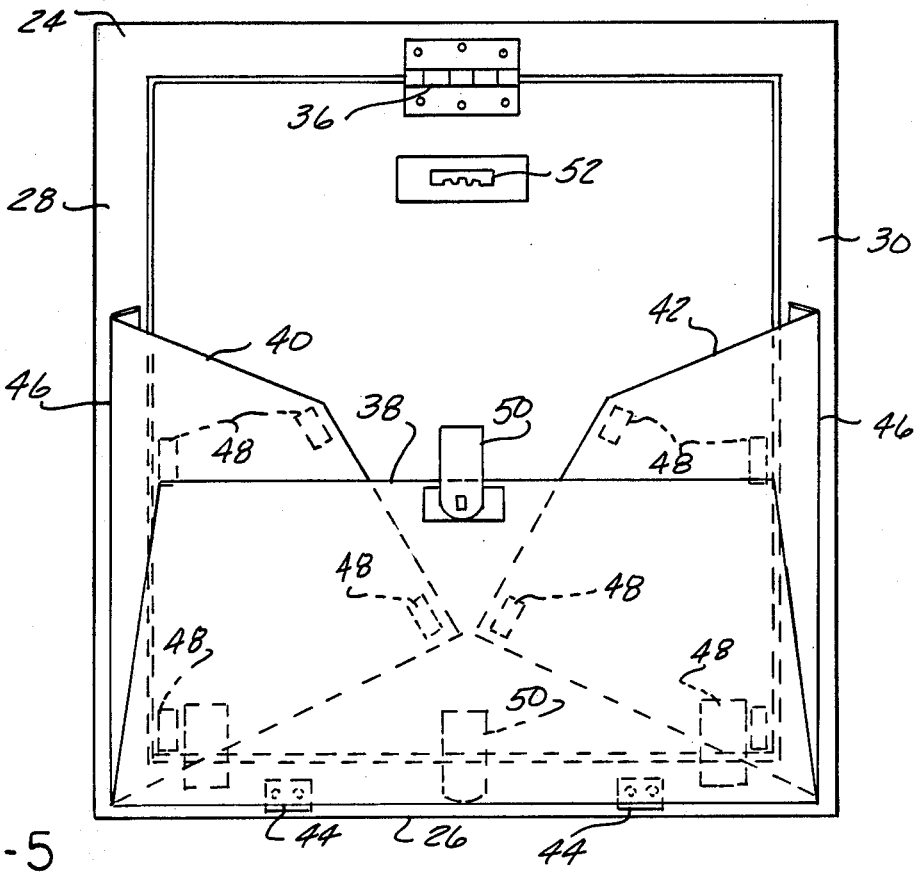
FIG. 5 is a rear view of the back of the wall toss game with the catch area stored.

The catch means 34 preferably includes first hinge means 36 connected between the upper horizontal frame member 24 and the rigid member 12 allowing pivotal movement of the frame 22 between a first position, shown in FIG. 3, wherein the frame 22 is generally co-planar with the rigid member 12 and a second position, shown in FIG. 2, wherein the frame 22 angles outwardly with respect to the rigid member 12 such that the lower horizontal frame member 26 is spaced from the rigid member 12. A catch member 38 is connected between the lower horizontal frame member 26 and the rigid member 12 when the frame 22 is disposed in the second position. The catch member 38 is capable of supporting projectiles which miss the targets 20 and fall vertically downward after contacting the first surface 14. A pair of side panels 40 and 42 can also be provided connected at one end to the corresponding vertical frame members 28 and 30 and connected at another end to the rigid member 12 to substantially obstruct an area between the angled vertical frame members 28 and 30 and the rigid member 12 when the frame 22 is in the second position. Second hinge means 44 can be provided between the catch member 38 and the lower horizontal frame member 26 for pivoting the catch member 38 from a first stored position generally parallel to the rigid member 12 adjacent the second surface 16, as shown in FIGS. 3 and 5, into a second position generally perpendicular to the rigid member 12 extending outwardly with respect to the first surface 14 as shown in FIGS. 2 and 4. Third hinge means 46 can also be provided disposed between each side panel 40 and 42 and the corresponding vertical frame member 28 and 30 respectively, for pivoting the side panel between a first stored position generally parallel to the rigid member 12 adjacent the second surface 16, as shown in FIGS. 3 and 5, and a second position generally perpendicular to the rigid member 12 extending outwardly with respect to the first surface 14 as shown in FIGS. 2 and 4. As best seen in FIGS. 4 and 5, first means 48 are provided for securing the side panels in the second position. In the first position, the side panels 40 and 42 are preferably folded adjacent the second surface 16 of the rigid member 12 and disposed between the second surface 16 and the catch member 38. Second means 50 are provided for securing the catch member in the first and second positions. The first and second means for securing can include hook and loop material, such as Velcro. Supporting means 52 is provided connected to the second surface 16 of the rigid member 12 for supporting or hanging the rigid member 12 from the vertical wall surface 54.

Having disclosed certain preferred embodiments of the invention for purposes of explanation, further modifications or variations thereof, after study of this specification, will or may occur or become apparent to persons skilled in the art to which the invention pertains. It should be recognized that the present invention is not meant to be limited to the preferred embodiment described in detail, but rather reference should be made to the appendant claims in determining the scope of the present invention.

What is claimed is:

1. A wall hanging toss game comprising the combination of:

a generally flat, rigid member having a first surface suitable for printing, a second surface opposite from the first surface, and an outer periphery between the first and second surfaces, said first surface having a plurality of recesses formed therein spaced from one another;

a plurality of generally thin, wafer-like hook material targets adhesively secured to the rigid member in the recesses of the first surface, such that the targets appear generally flush with the first surface and appear separated from one another by open areas of the first surface;

a frame having spaced vertical frame members, an upper horizontal frame member and a lower horizontal frame member connected to one another and surrounding the periphery of the rigid member;

shock absorbing projectile means covered with loop material capable of being securely held in place when in contact with the hook material targets, said projectile means for throwing at the hook material targets from a distance; and catch means for catching and supporting the projectile means when the projectile means hit the first surface and fall vertically downwardly, said catch means supported from said frame.

2. The wall hanging toss game of claim 1, wherein said catch means comprises:

first hinge means connecting the upper horizontal frame member of the frame to the rigid member for pivotal movement between a first position wherein the frame is generally co-planar with the rigid member and a second position wherein the frame angles outwardly with respect to the rigid member such that the lower horizontal frame member is spaced from the rigid member; and a catch member connected between the lower horizontal frame member and the rigid member in the second position capable of supporting the projectile means.

3. The wall hanging toss game of claim 2 further comprising:

a pair of side panels, one side panel connected to a corresponding vertical frame member at one end and to the rigid member at another end to substantially obstruct an area between the vertical frame member and the rigid member when the frame is in the second position.

4. The wall toss game of claim 2 further comprising:

second hinge means disposed between the catch member and the lower horizontal frame member for pivoting the catch member between a first stored position generally parallel to the rigid member adjacent the second surface and a second position generally perpendicular to the rigid member extending outwardly with respect to the first surface.

5. The wall hanging toss game of claim 3 further comprising:

third hinge means disposed between each side panel and corresponding vertical frame member for pivoting the side panel between a first stored position wherein said side panel is disposed generally parallel to said rigid member adjacent said second surface and a second position wherein said side panel is generally perpendicular to said rigid member extending outwardly with respect to said first surface.

6. The wall hanging toss game of claim 5 further comprising:

first means for securing said side panels in said second position.

7. The wall hanging toss game of claim 4 further comprising:

second means for securing said catch member in said first and second positions.

8. The wall hanging toss game of claim 1 further comprising:

means connected to said second surface of said rigid member for supporting the rigid member from a vertical wall surface.

9. A wall hanging toss game comprising:

a flat, rigid member having first and second generally planar surfaces and a peripheral side edge extending between said first and second planar surfaces;

a plurality of hook material targets secured to the rigid member;

a frame having spaced vertical frame members, an upper horizontal frame member, and a lower horizontal frame member connected to one another and surrounding the peripheral side edge of the rigid member;

first hinge means connecting the rigid member to the upper horizontal frame member of the frame for pivoting movement of the frame from a first stored position generally co-planar with the rigid member to a second game position wherein the frame angles outwardly with respect to the rigid member such that the lower horizontal frame member is spaced from the rigid member;

a catch member connected to the lower horizontal frame member of the frame;

second hinge means connecting the catch member to the lower horizontal frame member for pivoting movement between a first stored position wherein the catch member is disposed generally parallel to the rigid member and adjacent the second surface and a second game position wherein the catch member extends between the lower horizontal frame member and the rigid member;

shock absorbing projectile means covered with loop material capable of being securely held in place when in contact with the hook material targets for throwing at the targets when the frame and the catch member are in the game position; and securing means between the rigid member and the catch member for holding the catch member in the game position.

10. The wall hanging toss game of claim 9 further comprising a pair of side panels, one side panel connected to a corresponding vertical frame member at one end and to the rigid member at another end to substantially obstruct an area between the vertical frame member and the rigid member when the frame is in the game position.

11. The wall toss game of claim 9 further comprising:

second hinge means disposed between the catch member and the lower horizontal frame member for pivoting the catch member between a first stored position generally parallel to the rigid member adjacent the second surface and a second position generally perpendicular to the rigid member extending outwardly with respect to the first surface.

12. The wall hanging toss game of claim 10 further comprising:

third hinge means disposed between each side panel and vertical frame member for pivoting the side panel between a first stored position wherein said side panel is disposed generally parallel to said rigid member adjacent said second surface and a second position wherein said side panel is generally perpendicular to said rigid member extending outwardly with respect to said first surface.

13. The wall hanging toss game of claim 12 further comprising:

first means for securing said side panels in said second position.

14. The wall hanging toss game of claim 11 further comprising:

second means for securing said catch member in said first and second positions.

15. The wall hanging toss game of claim 9 further comprising:

means connected to said second surface of said rigid member for supporting the rigid member from a vertical wall surface.

* * * * *